US010727628B2

(12) United States Patent
Hamed et al.

(10) Patent No.: US 10,727,628 B2
(45) Date of Patent: Jul. 28, 2020

(54) ELECTRICAL CONNECTOR HOUSINGS WITH CAM-LOCK COUPLINGS

(71) Applicants: Afshin Hamed, Calgary (CA); Peter Daniel Fudge, Calgary (CA); Afshar Hamed, Calgary (CA)

(72) Inventors: Afshin Hamed, Calgary (CA); Peter Daniel Fudge, Calgary (CA); Afshar Hamed, Calgary (CA)

( * ) Notice: Subject to any disclaimer, the term of this patent is extended or adjusted under 35 U.S.C. 154(b) by 0 days.

(21) Appl. No.: 15/629,657

(22) Filed: Jun. 21, 2017

(65) Prior Publication Data

US 2018/0375255 A1 Dec. 27, 2018

(51) Int. Cl.

| | |
|---|---|
| ***H01R 13/629*** | (2006.01) |
| ***H01R 24/20*** | (2011.01) |
| *H01R 13/627* | (2006.01) |
| *H01R 13/635* | (2006.01) |

(52) U.S. Cl.

CPC ..... *H01R 13/62977* (2013.01); *H01R 24/20* (2013.01); *H01R 13/6271* (2013.01); *H01R 13/6275* (2013.01); *H01R 13/62905* (2013.01); *H01R 13/62938* (2013.01); *H01R 13/62955* (2013.01); *H01R 13/635* (2013.01)

(58) Field of Classification Search

CPC ..... H01R 13/62905; H01R 13/62938; H01R 13/62955; H01R 13/635; H01R 13/6271; H01R 13/6275

USPC ..... 439/358, 351, 352, 361

See application file for complete search history.

(56) References Cited

U.S. PATENT DOCUMENTS

| | | | | |
|---|---|---|---|---|
| 8,328,574 | B1 * | 12/2012 | Lin | H01R 13/6275 439/321 |
| 8,882,520 | B2 * | 11/2014 | Youtsey | H01R 4/26 439/157 |
| 2017/0187158 | A1 * | 6/2017 | Crowe | H01R 13/6272 |

* cited by examiner

*Primary Examiner* — Abdullah A Riyami
*Assistant Examiner* — Justin M Kratt

(57) ABSTRACT

An electrical connectors housing for receiving a pair of mated electrical connectors designed to provide easy connection and prevent inadvertent disconnection of electrical connectors, comprises a male electrical connector housing member; a female electrical connector housing member configured to receive the male electrical connector housing member; and cam-lock couplings to lock together female and male electrical connector housing members.

16 Claims, 12 Drawing Sheets

ELECTRICAL CONNECTOR HOUSINGS WITH CAM-LOCK COUPLINGS

BACKGROUND OF THE INVENTION

Field of the Invention

The present invention relates to electrical connector housings and electrical connectors with said housings, and more particularly to electrical connector housings having cam lock couplings.

Description of Related Art

The pin and sleeve plugs have been used in a variety of areas such as refineries, construction sites, electrical power plants, pulp and paper mills etc. for a very long time. The standard pin and sleeve device look like the images demonstrated in FIG. 1. To be able to meet and satisfy the conventional plugs safety ratings (Nema 4X), the pin and sleeve receptacles must be secured in place at all times during its operation and the locking ring must be screwed in all the way in order to provide the seal. However, standard pin and sleeve receptacles have following drawbacks. The elongated pin end is sometimes difficult to insert all the way, especially in the higher amperage models. Over its short life time from general wear and tear, they can become extra loose fitting. Sometimes, because the plugs are dropped and/or dragged across mud, cement, paved pathways and metal gratings, the ring often becomes cross threaded and/or damaged in this process. Furthermore, because the harsh environment the plugs are deployed in and the abuse they endure, the threads that bind the seal are fragile and have a very short life span. For these reasons, they easily get cross-threaded and exposed to debris and ice, the plugs are not capable of being secured properly as prescribed, as such the operators tend to just plug the receptacle in and disregard the most important part, which is screwing in the shell and sealing the plug. FIG. 2 demonstrates such common problems occurred when the plug and receptacle are not tightly sealed. If not noticed and mitigated right away, this common problem immediately affects the integrity of the plug and its ratings for non-hazardous/hazardous locations in which it has been approved. This negligence triggers an immense safety issue. Without the seal being completely screwed on, the plug exposes the operators to many dangerous hazards.

Consequently, there exists a need for a modified and improved version of a typical pin and sleeve device that can connect quickly, with ease, and is secured with a lock to ensure safety of users.

SUMMARY OF THE INVENTION

According to one aspect of the present invention, the devices are designed to keep the pin and sleeve receptacles secure and weather proof whilst extending the life span of the plug without having to replace the shell due to the threads being easily cross-threaded and damaged.

According to another aspect of the present invention, the devices are designed for light/heavy duty industrial use. The devices supply power to both fixed and portable electrical equipment including generators, blowers, pumps, welders, and comparable machinery. The devices are designed for both indoor and outdoor.

According to another aspect of the present invention, the device has no threads on the plug. It connects quickly, with ease and is secured with cam-lock levers. This eliminates the worry of an improperly sealed plug or loose fit plug due to a locking ring not being correctly installed. The device of the present invention utilizes a higher-grade aluminum ensuring a more rigid body, better structural integrity and long-lasting durability. All units of the device of the present invention come anodized. The device of the present invention is available in 30, 60 and 100 Amp.

According to another aspect of the present invention, the device resembles that of Powertite™ and Crouse Hinds Arktite™. For workers who are used to existing Powertite™ and Arktite™ installations they will be able to migrate over to installing the devices of the present invention with a great deal of familiarity, general ease and be guided by a thorough instruction pamphlet. For the worker just learning to use the device of the present invention, the embodiments according to the present invention come ready to wire, for a quick and simple installation. The units of the device of the present invention are anodized to a basic colouring scheme. Colouring of the plugs is the first line of defense of knowing the partner receptacle and voltage. In order to provide safety and protection of workers, the embodiment of the present invention is made of off the shelf inner plug and receptacle parts that align with the tongue and groove system of the embodiment of the present invention. This ensures the plugs of the present invention only fit one way and the grounds will touch first and break last.

According to one aspect of the present invention, disclosed herein is a set of electrical connector housings, comprising: a male housing member configured to house a male electrical connector; a female housing member complementary to said male housing member configured to house a female electrical connector complementary to said male electrical connector; and cam-lock couplings to lock female housing member and male housing member together; wherein a front portion of said male housing member is configured to snugly fitted into a front portion of said female housing member and locked inside said front portion of said female housing member by cam-lock couplings, whereby said male and female electrical connectors are locked together.

According to a further aspect of the present invention, said cam-lock couplings comprises a grooved portion on said front portion of said male housing member and a pair of cam levers on said front portion of female housing member.

According to a further aspect of the present invention, said electrical connector housings further comprises a wall mount receptacle, said wall mount receptacle comprising a front piece integrally attached to a solid plate, wherein said front piece comprising a pair of cam levers.

According to a further aspect of the present invention, said electrical connector housings further comprises a female electrical connector coming with a cable, and a complementary male electrical connector coming with a cable.

According to one aspect disclosed herein is a set of electrical connector housings for providing easy-to-connect housing for a pair of mated electrical connectors and preventing inadvertent disconnection of the connectors once attached to each other, the set comprises: a female housing member configured to house a female electrical connector, said female housing member having a front piece which has two pairs of protrusions, each pair of said protrusions supporting a bar on which is pivotally mounted a cam lever at right angles to the central axis of said female housing member when said cam lever is at an open position; a complementary male housing member configured to house said male electrical connector, said male housing member having a front piece which has an external circumferential grooved portion thereon, wherein said front piece of male housing member is configured to be snugly fitted into said front piece of female housing member such that said male and female electrical connectors can be snugly fitted into each other, and the head of cam levers are configured to engage said grooved portion when said cam levers are pushed down towards the end of the female housing member such that said male housing member and said female housing member are securely locked together.

According to a further aspect, the front pieces of both female and male housing members have grounding support points where a ground cable can be secured via a screw.

According to a further aspect, the set of electrical connector housings further has a center piece and a cable clamp piece for both female and male housing members, the center piece is configured to connect to a rear end of said front piece and to a front end of the cable clamp piece. The center piece has external grooves thereon parallel with the central axis of the center piece for a firm and sure grip when connecting or disconnecting from said front piece and cable clamp piece, said cable clamp piece is configured to receive and clamp a cable to be attached to an electrical connector.

According to a further aspect, the set of electrical connectors stored in a set of electrical connectors housing comprises a female wall mount which comes with grounding support points where a ground cable can be secured via a screw.

According to another aspect, disclosed herein is a set of electrical connectors stored in a set of secure housings to provide easy connection between electrical connectors and prevent electrical connectors from inadvertent disconnection once attached to each other, the set comprises: a female electrical connector and attached cable, a complementary male electrical connector and attached cable, a female housing member configured to house a female electrical connector, said female housing member having a front piece which has two pairs of protrusions, each pair of said protrusions supporting a bar on which is pivotally mounted a cam lever at right angles to the central axis of said female housing member when said cam lever is at a relaxed position; a complementary male housing member configured to house said male electrical connector, said male housing member having a front piece which has an external circumferential grooved portion thereon, wherein said front piece of male housing member is configured to be snugly fitted into said front piece of female housing member such that said male and female electrical connectors can be snugly fitted into each other, and the head of cam levers are configured to engage said grooved portion when said cam levers are pushed down towards the end of the female housing member such that said male housing member and said female housing member are securely locked together, whereby the female and male electrical connectors are securely locked together.

According to a further aspect, the front pieces of both female and male housing members have grounding support points where a ground cable can be secured via a screw.

According to a further aspect, the set of electrical connector housings further has a center piece and a cable clamp piece for both female and male housing members, the center piece is configured to connect to a rear end of said front piece and to a front end of the cable clamp piece. The center piece has external grooves thereon parallel with the central axis of the center piece for a firm and sure grip when connecting or disconnecting from said front piece and cable clamp piece, said cable clamp piece is configured to receive and clamp a cable to be attached to an electrical connector.

According to a further aspect, the set of electrical connectors stored in a set of electrical connector housings comprises a female wall mount which comes with grounding support point where a ground cable can be secured via a screw.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
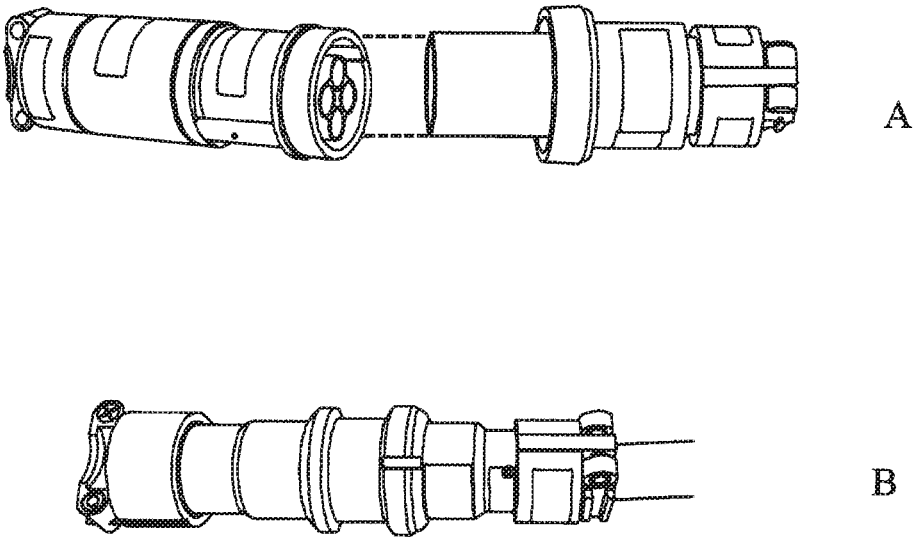
FIG. 1 (Prior Art)
FIG. 1 illustrates a standard pin and sleeve device (prior art) (A) open and (B) closed.
Figure 2:
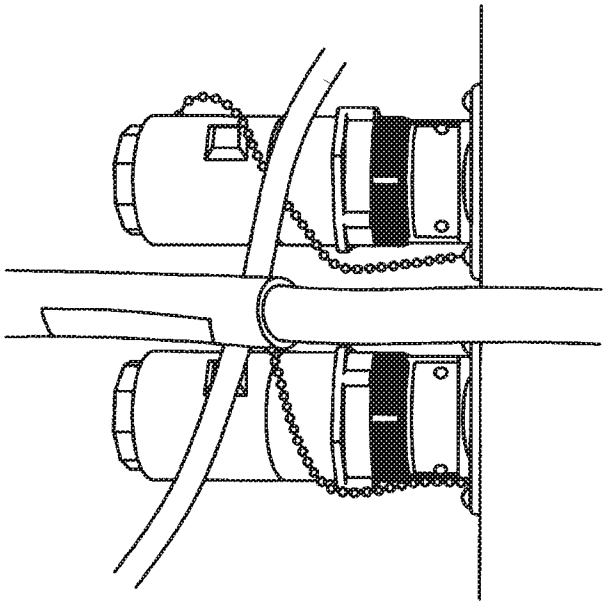
FIG. 2 (Prior Art)
FIG. 2 illustrates a standard pin and sleeve device (prior art) in operation.
Figure 3:
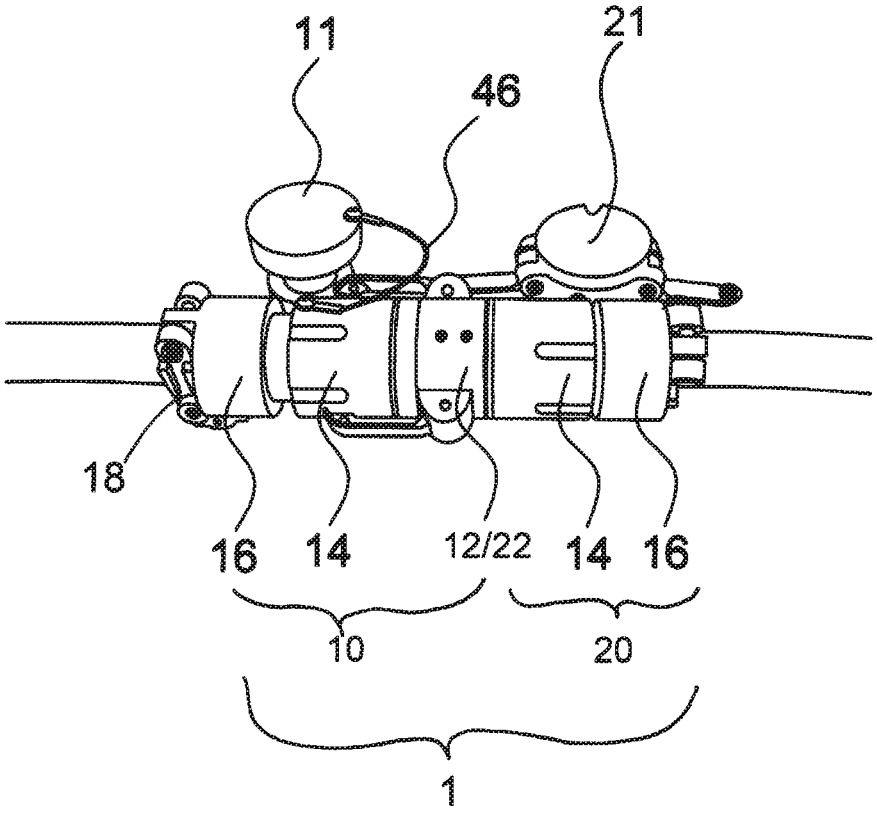
FIG. 3 illustrates a set of modified and improved version of the standard plug and sleeve device according to one embodiment of the present invention where a female electrical connector and a male electrical connector are attached together.
Figure 4:
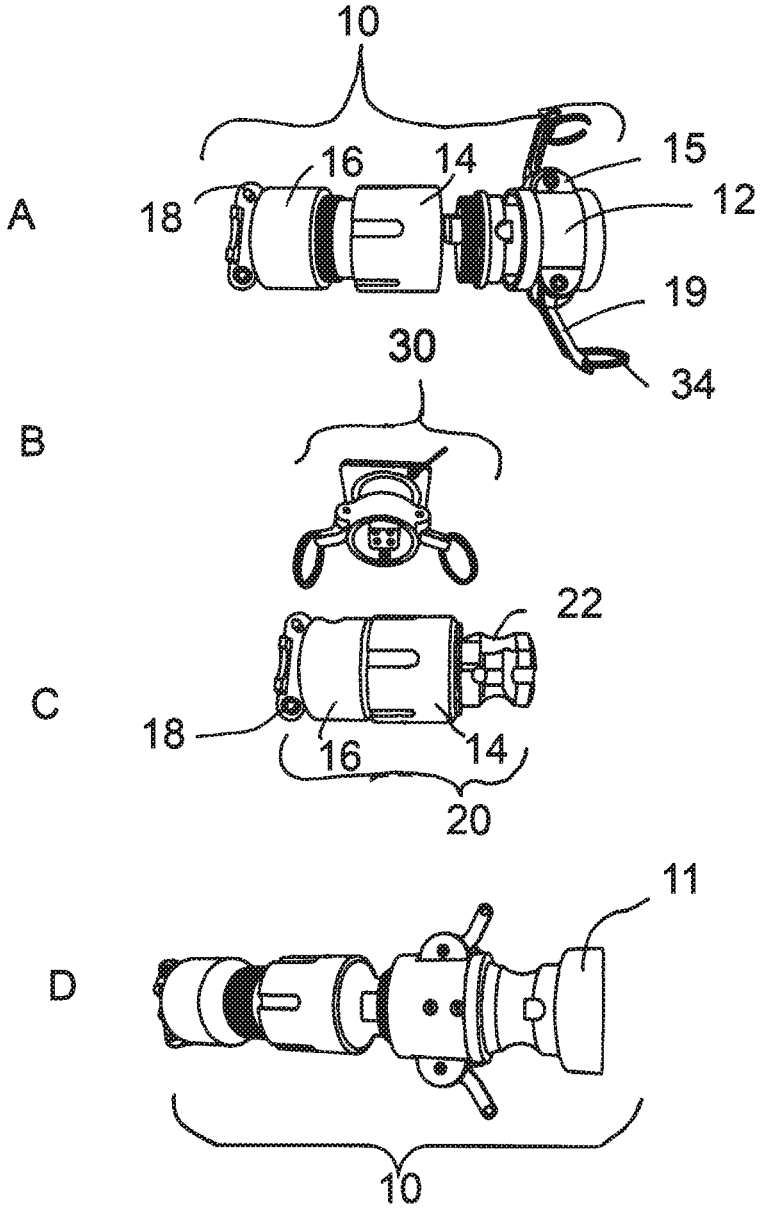
FIG. 4 illustrates (A) a female housing member, (B) a female wall mount, (C) a male housing member, and (D) a female housing member including a male end cap.
Figure 5:
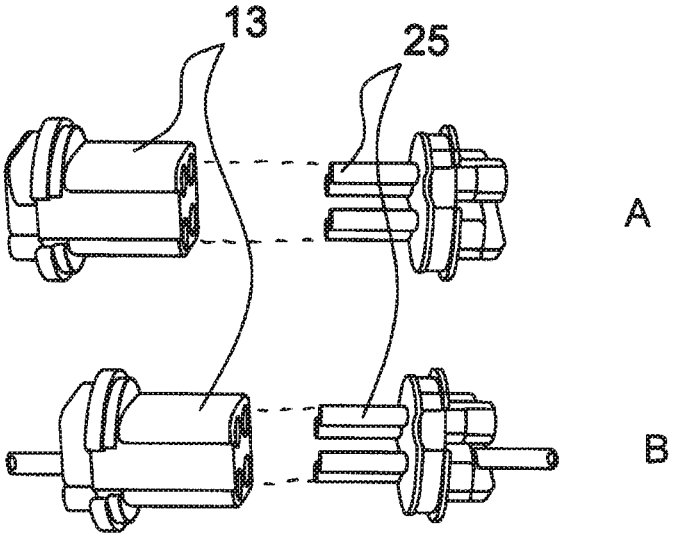
FIGS. 5 (A) and (B) is a perspective view of a female electrical connector and a male electrical connector.

Referring to FIG. 3, there is disclosed a set of modified and improved electrical connectors housing 1 including female housing member 10 and male housing member 20 attached to each other in a linear fashion. FIG. 4 demonstrates (A) a female housing member 10, (B) a female wall mount 30, (C) a male housing member 20, and (D) a female housing member 10 including a male end cap 11. FIG. 5 is a perspective view of a female ended connector and a male ended connector.

Figure 6:
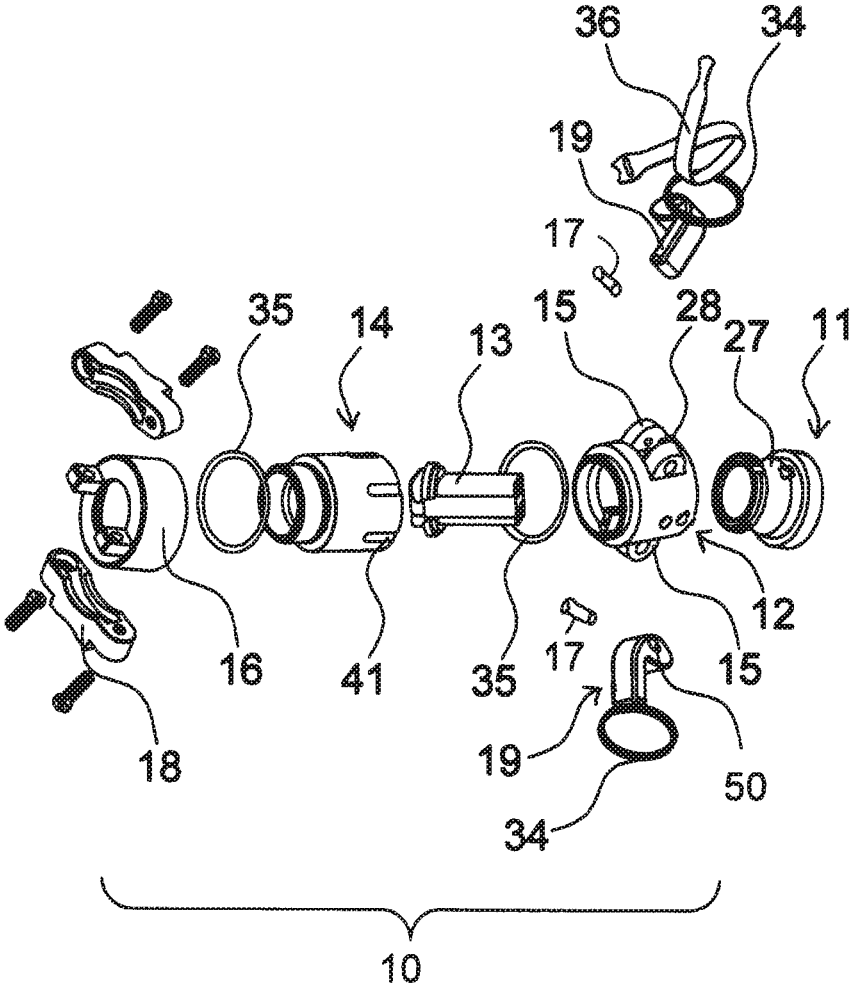
FIG. 6 is an exploded view of a female housing member according to one embodiment of the present invention.

FIG. 6 is an exploded view of the female assembly 10, comprising a female front piece 12, a center tube 14, a cable clamp body 16, a cable clamp 18, and rubber O-ring seal 35. These components are aligned and connected in a linear fashion to form a tubular shape to house a female electrical connector, such as a sleeve receptacle 13 in this embodiment. The female front piece 12 has a front opening adapted to receive the front piece of the male assembly 22 (see FIG. 7), and a rear opening adapted to connect to the front end of the center tube 14. The rear end of the center tube is adapted to connect to the cable clamp body 16. Female assembly 10 further comprises a male end cap 11, adapted to close the front opening of the front piece 12 in order to protect the female connector during transportation. The male end cap 11 prevents the female electrical connector and the female housing member from mud or dust. The male end cap 11 comes with sturdy lanyard 46 (referring to FIG. 3) tethered to the center tube when not in use to prevent cap misplacement.

The electrical connector housings according to the present invention has cam lock couplings to ensure that once the male assembly 20 and female assembly 10 are connected, they are securely locked together to ensure no inadvertent disconnection. In one of embodiments according to the present invention, the female assembly 10 carries a pair of cam levers 19, each of which is pivotally mounted on a bar 17 between two parallel protrusions 15 from the exterior wall of the front piece 12. The pair of cam levers are separate approximately 180 degree from each other located on opposite side of the front piece. At an open position meaning the cam levers are not depressed, the cam levers 19 are at approximately a right angle to the central axis of the female assembly 10. The female front piece further comprises two side openings 28, each of said side openings 28 is located between each pair of protrusions 15. When the cam levers 19 are depressed, meaning the cam levers 19 are at a closed position, the heads 50 of the cam levers 19 swing through the side openings 28 to engage the grooved portion 27 on the male front piece 22 so that the female front piece 12 and the male front piece 22 are securely locked, whereby securely locking the electrical connectors. At the end of the cam lever, a lever O-ring 34 is attached which is wide enough to easily fit fingers with gloves on so that the lever can be pulled using the lever O-ring. The female assembly 10 further comprises fire retardant Velcro hook and loop straps 36 to secure the levers 19 in place and keep the lever O-ring 34 organized. The sleeve receptacle 13 is compatible with commercially available plugs including but not limited to Appleton Powertite™ and Crouse Hinds plug. The female front piece 12 comes with grounding support point 42 where a ground cable can be secured via a screw. The female front piece 12 is made of material including but not limited to aluminum. In one embodiment, the female front piece 12 has an anodize finish.

The center tube 14 comes with grooves 41 for a firm and secure grip when connecting or disconnecting, featured on both plug and cable connector bodies. When clamp body 16 and female front piece 12 are secured on connector center tube 14 and leavers secured in place, the female assembly has Nema 4X rating.

Figure 7:
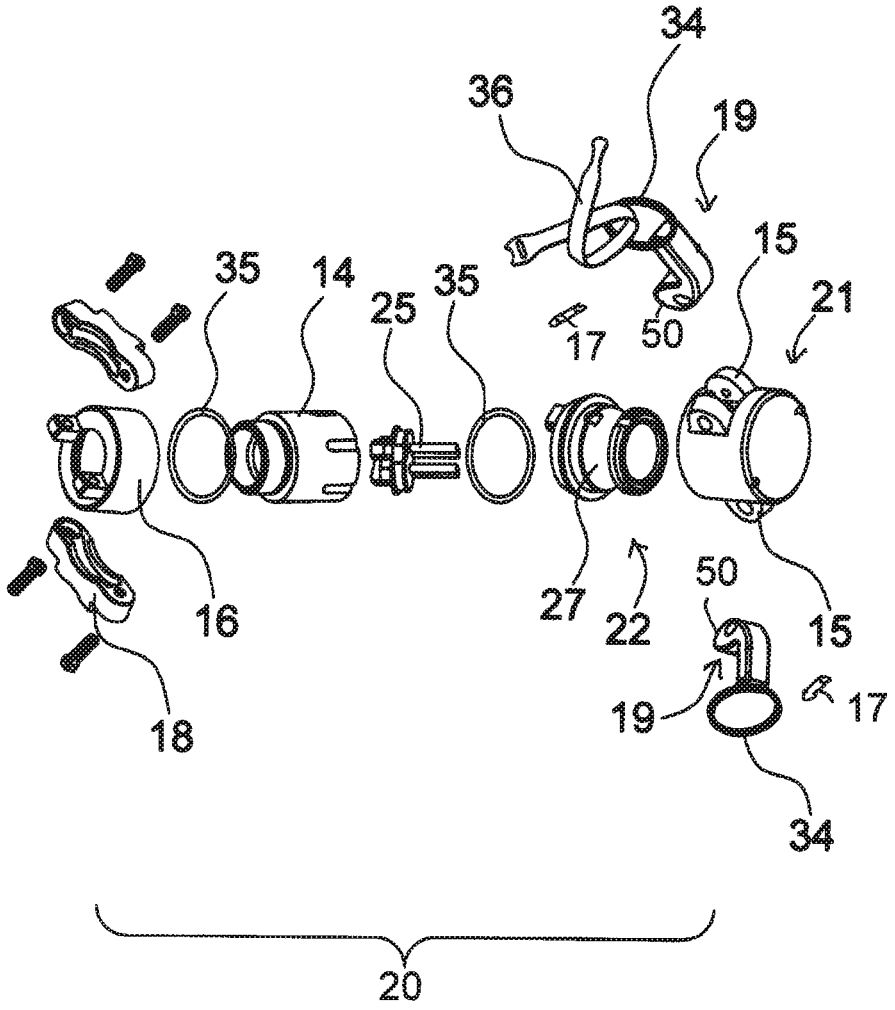
FIG. 7 is an exploded view of a male housing member according to one embodiment of the present invention.

Referring to FIG. 7 there is disclosed an exploded view of a male assembly 20 according to one embodiment of the present invention. The male assembly 20 comprises a male front piece 22, a center tube 14, and a cable clamp body 16, a cable clamp 18, and rubber O-ring seals 35. These components are connected in a linear fashion to form a tubular shape to house a male electrical connector, such as a pin plug 25 in this embodiment. The male front piece 22 has a front opening and a rear opening. The end opening of the male front piece 22 is connected to the front end of the center tube 14, of which the rear end is connected to the cable clamp body 16. Male assembly 20 further comprises a female end cap 21 to close the front opening of the male front piece 22 in order to prevent the male electrical connector and male housing assembly from mud or dust. The female end cap 21 comes with sturdy lanyard 46 (referring to FIG. 3) tethered to the center tube when not in use to prevent cap misplacement.

The male front piece 22 is configured to snuggly fitted into the female front piece 12 of the female assembly 10. The male front piece 22 has an exterior circumferential groove portion 27, which forms an engaging surface for the cam lever of the female front piece to engage.

Figure 8:
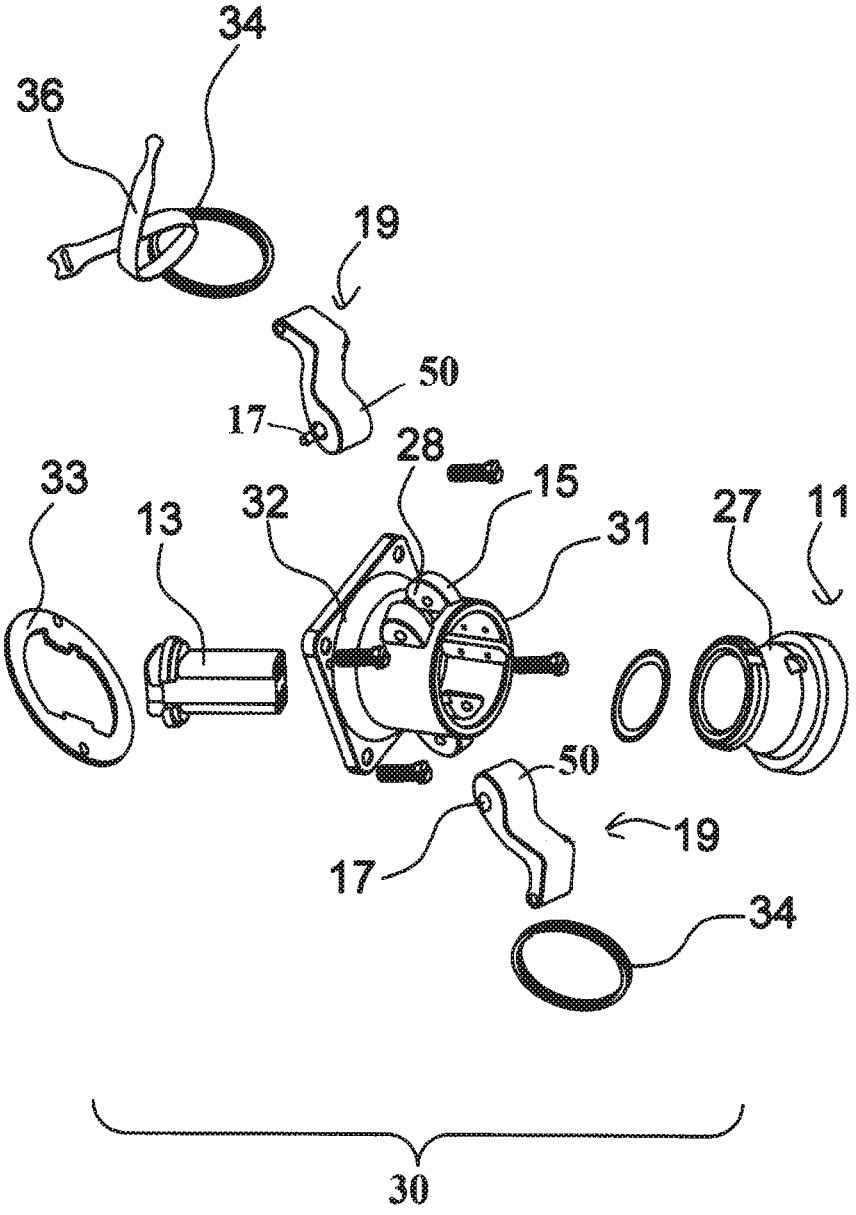
FIG. 8 is an exploded view of a female wall mount according to one embodiment of the present invention.

The set of electrical connector housings 1 further comprises a wall mount receptacle (i.e. female wall mount) 30 for receiving the male assembly 20. As demonstrated in FIG. 8, there is disclosed an exploded view of the wall amount receptacle 30. The wall amount receptacle 30 comprises a front piece 31 attached to a solid plate 32 and fiber glass back plate 33. The front piece 31 comprises cam lock couplings, which has cam levers 19, two pairs of protrusions 15, bars 17, and side openings 28 as described earlier to prevent inadvertent disconnection from the male assembly 20.

Figure 9A:
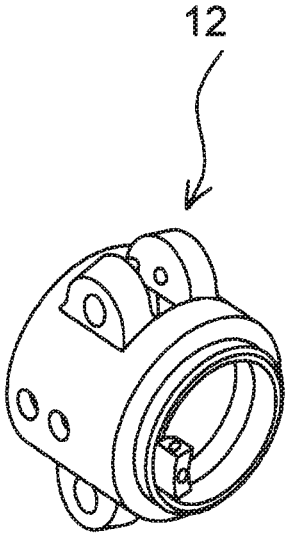
FIG. 9 shows a perspective view (A) and a section view (B) of a female front piece according to one embodiment of the present invention.
Figure 9B:
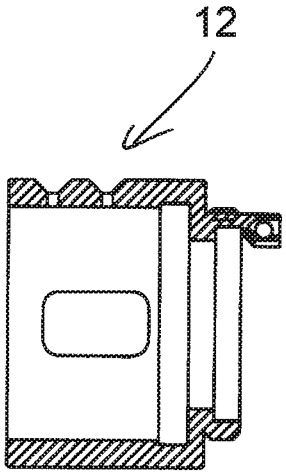
Figure 10A:
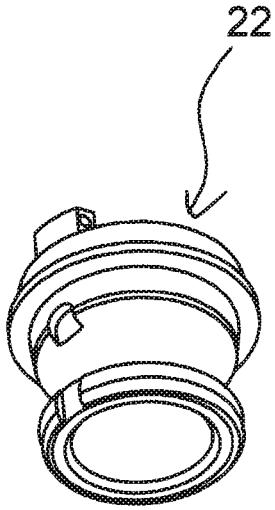
FIG. 10 shows a perspective view (A) and a section view (B) of a male front piece according to one embodiment of the present invention.
Figure 10B:
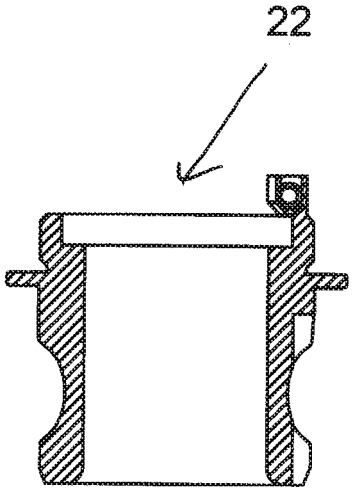

FIG. 9 shows a perspective view (A) and a section view (B) of a female front piece 12 according to one embodiment of the present invention. FIG. 10 shows a perspective view (A) and a section view (B) of a male front piece 22 according to one embodiment of the present invention.

In operation, a user inserts the male front piece 22 into the female front portion 12 of the female assembly 10, whereby the male electrical connector 25 is inserted into the female electrical connector 13. Then, the user depresses the cam levers 19; the heads of the cam levers 19 swing through side openings 28 to engage the grooved portion 27 on the male front piece 22, thereby, locking the front piece 22 of the male assembly inside the female assembly. Consequently, the male electrical connector 25 is securely locked into the female connector 13 and thus, preventing inadvertent disconnection of the connectors. Because the user only needs to push the male assembly into the female assembly and depresses the cam levers, the operation is facile, the chance for someone to forget to securely assemble the connectors is significantly minimized. When the user wants to disconnect the electrical connectors, he simply lifts the cam levers 19 and pulls the male assembly 20 from the female assembly 10.

Figure 11:
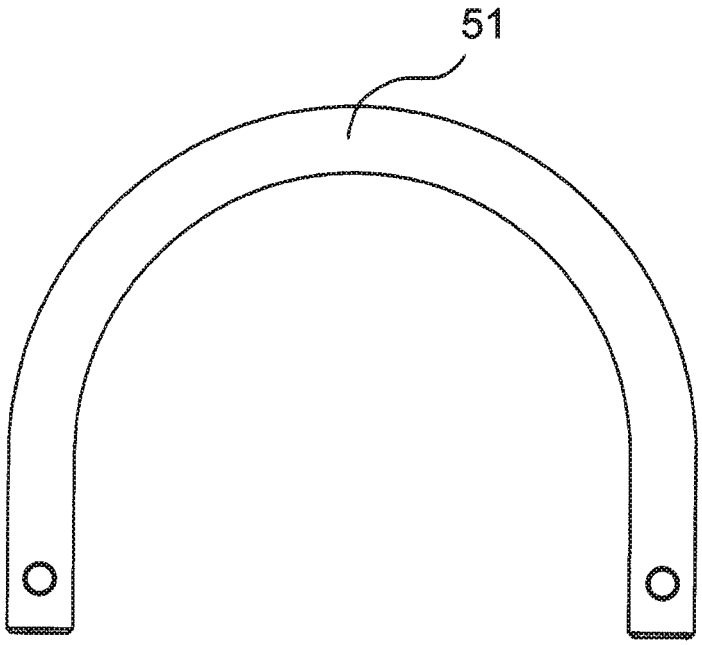
FIG. 11 is a perspective view of a locking bracket.
Figure 12:
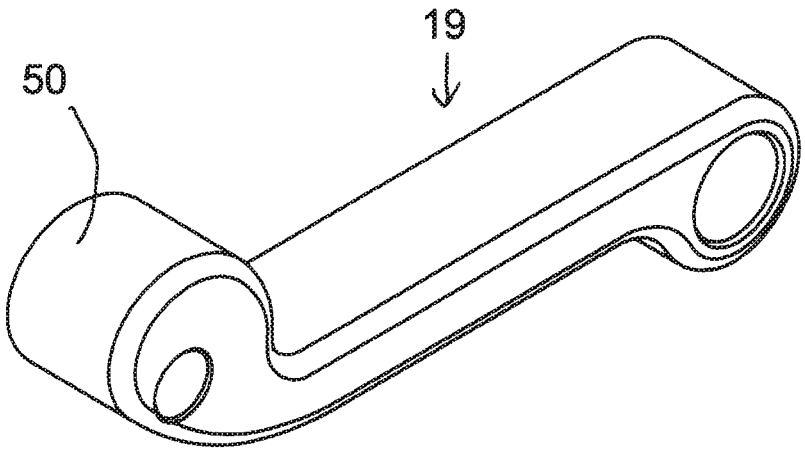
FIG. 12 is a perspective view of a long handle with locking holes.

In FIG. 11, shows a perspective view of a locking bracket 51. This locking bracket fits into the cam lever, see FIG. 12, a perspective view of a long arm cam lever 19, offering the ability to allow only authorized individuals to use said lever.

In another embodiment of the present invention, said male front piece has a notch and said female front piece has a protruding part configured to match said notch for providing additional safety.

When all components of the housings of the present invention are screwed on firmly, the housings provide Type 4X enclosures constructed for either indoor or outdoor use. The housings of the present invention provide a degree of protection to personnel against access to hazardous parts. The housings of the present invention also provide a degree of protection of the equipment inside the enclosure against ingress of solid foreign objects (windblown dust), water (rain, sleet, snow, splashing water, and hose directed water). The housings of the present invention provide an additional level of protection against corrosion; and that will be undamaged by the external formation of ice on the enclosure.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. Easy-to-connect electrical connector housings comprising:

a male housing member configured to house a male electrical connector, said male housing member comprising:

a male front piece, said male front piece being in a tubular shape comprising: a front opening; a rear end; and an external annular grooved portion thereon near said front opening; and a female housing member complementary to said male housing member configured to house a female electrical connector complementary to said male electrical connector, said female housing member comprising:

a female front piece, said female front piece being in a tubular shape comprising: a front opening for insertion of said male housing member; a rear end; two pairs of external protrusions thereon located on opposite sides near said front opening, each pair of said protrusions supporting a bar on which is pivotally mounted a cam lever at approximately a right angle to the central axis of said female housing member when said cam lever is not depressed, said cam lever is at an open position; and two side openings, each said side openings is located between each pair of protrusions;

wherein said male front piece is configured to be snugly fitted into said female front piece such that said male and female electrical connectors can be properly connected; and said cam levers are configured to engage said grooved portion such that when said cam levers are depressed, said cam levers are at a closed position, heads of the cam levers swing through said side openings and engage said grooved portion, whereby locking said male and female housing members and said female and male electrical connectors.

2. The easy-to-connect electrical connector housings of claim 1, wherein said male and female front pieces have a grounding support point where a ground cable can be secured via a screw.

3. The easy-to-connect electrical connector housings of claim 1, wherein said female housing member further has a center piece and a cable clamp piece, said center piece is configured to connect to said rear end of said female front piece and to a front end of said cable clamp piece, said center piece has external grooves thereon parallel with the central axis of said center piece for a firm and sure grip when connecting or disconnecting from said female front piece and cable clamp piece, said cable clamp piece is configured to receive and clamp a cable that is coming with said female electrical connector.

4. The easy-to-connect electrical connector housings of claim 1, wherein said male housing member further has a center piece and a cable clamp piece, said center piece is configured to connect to said rear end of said male front piece and to a front end of said clamp piece, said center piece has external grooves thereon parallel with its own central axis for a firm and sure grip when connecting or disconnecting from said male front piece and cable clamp piece, said cable clamp piece is configured to receive and clamp a cable that is coming with said male electrical connector.

5. The easy-to-connect electrical connector housings of claim 1, further comprising a wall mount receptacle and male end cap, said wall mount receptacle comprising a front piece integrally attached to a solid plate; wherein said front piece comprising: a front opening for insertion of said male housing member; two pairs of external protrusions thereon located on opposite sides near said front opening, each pair of said protrusions supporting a bar on which is pivotally mounted a cam lever; and two side openings, each of said side openings located between each pair of protrusions allowing a head of said cam lever to swing through to engage said groove portions on the male front piece; and wherein said solid plate has holes and screws to attach to a wall.

6. The easy-to-connect electrical connector housings of claim 3, further comprising a male end cap coming with a lanyard, wherein said male end cap is configured to close said female front piece when said female housing member is not in use to protect the female electrical connector, wherein said lanyard is connected to said female housing member to prevent the male end cap from misplacement.

7. The easy-to-connect electrical connector housings of claim 4, further comprising a female end cap coming with a lanyard, wherein said female end cap is configured to close said male front piece when said male housing member is not in use to protect the male electrical connector, wherein said lanyard is connected to said male housing member to prevent the female end cap from misplacement.

8. The easy-to-connect electrical connector housings of claim 1, wherein said male front piece has a notch and said female front piece has a protruding part configured to match said notch for providing additional safety.

9. A pair of mated electrical connectors, comprising:

a female electrical connector;

a complementary male electrical connector;

a male housing member configured to house said male electrical connector, said male housing member comprising:

a male front piece, said front piece being in a tubular shape comprising: a front opening; a rear end; and an external annular grooved portion thereon near said front opening; and a female housing member complementary to said male housing member configured to house said female electrical connector complementary to said male electrical connector, said female housing member comprising:

a female front piece, said front piece being in a tubular shape comprising: a front opening for insertion of said male housing member; a rear end; two pairs of external protrusions thereon located on opposite sides of said female front piece and near said front opening, each pair of said protrusions supporting a bar on which is pivotally mounted a cam lever at approximately a right angle to the central axis of said female housing member when said cam lever is at an open position; and two side openings, each of said side openings is located between each pair of protrusions;

wherein said male electrical connector is configured to be snugly fitted into said female electrical connector, said male front piece is configured to be snugly fitted into said female front piece such that said male and female electrical connectors can be properly connected, and said cam levers are configured to engage said grooved portion such that when said cam levers are at a closed position, heads of the cam levers swing through said side openings and engage said grooved portion, whereby locking said male and female housing members and said female and male electrical connectors.

10. The pair of mated electrical connectors of claim 9, wherein said male and female front pieces have grounding support points which secure a ground cable via a screw.

11. The pair of mated electrical connectors of claim 9, wherein said female housing member further has a center piece and a cable clamp piece, said center piece is configured to connect to said rear end of said female front piece and to a front end of said cable clamp piece, said center piece has external grooves thereon parallel with the central axis of said center piece for a firm and sure grip when connecting or disconnecting from said female front piece and cable clamp piece, said cable clamp piece is configured to receive and clamp said cable that is coming with said female electrical connector.

12. The pair of mated electrical connectors of claim 9, wherein said male housing member further has a center piece and a cable clamp piece, said center piece is configured to connect to said rear end of said male front piece and to a front end of said clamp piece, said center piece has external grooves thereon parallel with its own central axis for a firm and sure grip when connecting or disconnecting from said male front piece and cable clamp piece, said cable clamp piece is configured to receive and clamp said cable that is coming with said male electrical connector.

13. The pair of mated electrical connectors of claim 9, further comprising a wall mount receptacle, said wall mount receptacle comprising a front piece integrally attached to a solid plate, wherein said front piece comprising: a front opening for insertion of said male housing member; two pairs of external protrusions thereon located on opposite sides near said front opening, each pair of said protrusions supporting a bar on which is pivotally mounted a cam lever; and two side openings, each of said side openings located between each pair of protrusions allowing a head of said cam lever to swing through to engage said grooved portions on the male front piece; and wherein said solid plate has holes and screws to attach to a wall.

14. The pair of mated electrical connectors of claim 9, further comprising a male end cap coming with a lanyard, wherein said male end cap is configured to close said female front piece when said female housing member is not in use to protect the female electrical connector, wherein said lanyard is connected to said female housing member to prevent the male end cap from misplacement.

15. The pair of mated electrical connectors of claim 9, further comprising a female end cap coming with a lanyard, wherein said female end cap is configured to close said male front piece when said male housing member is not in use to protect the male electrical connector, wherein said lanyard is connected to said male housing member to prevent the female end cap from misplacement.

16. The pair of mated electrical connectors of claim 9, wherein said male front piece has a notch and said female front piece has a protruding part configured to match said notch for providing additional safety.

* * * * *